US012716615B2

(12) United States Patent
Min et al.

(10) Patent No.: US 12,716,615 B2
(45) Date of Patent: Aug. 25, 2026

(54) BURNER AND WATER HEATER COMPRISING SAME

(71) Applicant: KYUNGDONG NAVIEN CO., LTD., Pyeongtaek-si (KR)

(72) Inventors: Kyung Tae Min, Seoul (KR); Hyoung Rae Kim, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 400 days.

(21) Appl. No.: 18/285,770

(22) PCT Filed: Apr. 7, 2022

(86) PCT No.: PCT/KR2022/005058
§ 371 (c)(1),
(2) Date: Oct. 5, 2023

(87) PCT Pub. No.: WO2022/220491
PCT Pub. Date: Oct. 20, 2022

(65) Prior Publication Data

US 2024/0369260 A1 Nov. 7, 2024

(30) Foreign Application Priority Data

Apr. 14, 2021 (KR) ..... 10-2021-0048778
Apr. 5, 2022 (KR) ..... 10-2022-0042484

(51) Int. Cl.
*F23D 14/14* (2006.01)
*F24H 9/00* (2022.01)
*F24H 9/1836* (2022.01)

(52) U.S. Cl.
CPC ..... *F24H 9/1836* (2013.01); *F24H 9/0026* (2013.01)

(58) Field of Classification Search
CPC .... F24H 9/0005; F24H 9/0026; F24H 9/1832; F24H 9/1836; F24H 9/18; F24H 1/22;
(Continued)

(56) References Cited

U.S. PATENT DOCUMENTS 10,571,152 B2 * 2/2020 Matsunaga ..... F24H 1/14
10,767,901 B2 * 9/2020 Ono ..... F24H 9/1836
(Continued)

FOREIGN PATENT DOCUMENTS

CN 101910725 A 12/2010
CN 105889915 A 8/2016
(Continued)

OTHER PUBLICATIONS

International Search Report and Written Opinion received in International Application No. PCT/KR2022/005058, mailed on Jul. 6, 2022.
(Continued)

*Primary Examiner* — Gregory A Wilson
(74) *Attorney, Agent, or Firm* — ALG Intellectual Property, LLC

(57) ABSTRACT

According to the present invention, a burner for a water heater located upstream of a combustion chamber on the basis of a reference direction, which is a flow direction of a combustion gas generated by a combustion reaction, comprises a plate-shaped distribution plate for generating a combustion reaction, wherein: when one direction orthogonal to the reference direction is referred to as a longitudinal direction, and a direction perpendicular to the reference direction and the longitudinal direction is referred to as a width direction, a plurality of through-holes formed through the distribution plate along the reference direction so that a mixture of fuel and air for the combustion reaction pass
(Continued)

through, are formed to be spaced apart from each other in the longitudinal direction and the width direction.

17 Claims, 11 Drawing Sheets

(58) Field of Classification Search
CPC . F24H 8/00; F23D 14/58; F23D 14/84; F23D 14/145; F23D 14/14
See application file for complete search history.

(56) References Cited

U.S. PATENT DOCUMENTS

| | | | | |
|---|---|---|---|---|
| 2010/0291495 | A1* | 11/2010 | Scribano | F23D 14/105 431/174 |
| 2011/0053105 | A1 | 3/2011 | Kim | |
| 2016/0238243 | A1 | 8/2016 | Gilioli et al. | |
| 2018/0216848 | A1 | 8/2018 | Jeong | |
| 2020/0271353 | A1* | 8/2020 | Ono | F24H 1/107 |

FOREIGN PATENT DOCUMENTS

| | | | | | |
|---|---|---|---|---|---|
| CN | 110388749 | A | * | 10/2019 | F28F 3/08 |
| CN | 210069846 | U | | 2/2020 | |
| CN | 210801178 | U | * | 6/2020 | |
| CN | 211260790 | U | | 8/2020 | |
| CN | 111964059 | A | * | 11/2020 | F23L 9/00 |
| CN | 110617477 | B | * | 3/2021 | F23D 14/62 |
| CN | 112594688 | A | * | 4/2021 | F23D 14/46 |
| CN | 216448157 | U | * | 5/2022 | |
| EP | 2227655 | B1 | | 8/2012 | |
| ES | 2769814 | T3 | * | 6/2020 | F23D 14/08 |
| KR | 1020170011448 | A | | 2/2017 | |
| KR | 1020200095240 | A | | 8/2020 | |
| WO | WO-2022012398 | A1 | * | 1/2022 | F24H 9/1836 |

OTHER PUBLICATIONS

Office Action received in CN Patent Application No. 202280028210.4 on Nov. 26, 2025.

* cited by examiner

BURNER AND WATER HEATER COMPRISING SAME

RELATED APPLICATIONS

The present application is a U.S. National Stage Application under 35 U.S.C. § 371 of International Application No. PCT/KR2022/005058, filed Apr. 7, 2022, which claims priority to Korean Patent Application No. 10-2021-0048778 filed Apr. 14, 2021, and to Korean Patent Application No. 10-2022-0042484 filed Apr. 5, 2022, each of which is hereby incorporated by reference in its entirety.

TECHNICAL FIELD

The present disclosure relates to a burner, and a water heater including the same.

BACKGROUND ART

A water heater is a device that is used to deliver heat generated through a combustion reaction to water, for heating or supplying hot water. A process of introducing water, heating the introduced water, and discharging the heated water is performed through a water heater.

The combustion reaction may occur in a burner, and a fuel is necessary for the burner to cause the combustion reaction. While the fuel passes through through-holes that are formed in the burner, ignitions occur in a state, in which it is advantageous to form flames, and the flames may be generated during the combustion reaction.

The heat generated in the burner is used to heat the water, but in the process, excessive heat is delivered to other components that constitute the water heater whereby the other components may be deformed or damaged or may not perform their functions. In particular, because peripheries of the flames generated in the burner are spread out, an inner wall of the combustion chamber may be excessively heated, and this deteriorates combustion performance to cause incomplete combustion whereby carbon monoxide may be excessively generated in the combustion reaction in the burner. As the incomplete combustion occurs, a thermal efficiency of the water heater may deteriorate.

DISCLOSURE

Technical Problem

An aspect of the present disclosure provides a burner for a water heater having an improved combustion performance, and a water heater including the same.

Technical Solution

According to an aspect of the present disclosure, a burner for a water heater, which is located on an upstream side of a combustion chamber with respect to a reference direction that is a flow direction of a combustion gas generated through a combustion reaction includes a plate-shaped distribution plate that generates the combustion reaction, when one direction that is perpendicular to the reference direction is defined as a lengthwise direction and a direction that is perpendicular to the reference direction and the lengthwise direction is defined as a widthwise direction, a plurality of through-holes are disposed in the distribution plate along the reference direction to be spaced apart from each other along the lengthwise direction and the widthwise direction such that a mixture of a fuel and air for the combustion reaction pass therethrough, and the distribution plate includes a central portion located at a center with respect to the widthwise direction, and outskirt portions located on opposite sides of the central portion, and a penetration density obtained by dividing a sum of areas of the through-holes located at the outskirt portions by areas of the outskirt portions is smaller than a penetration density obtained by dividing a sum of areas of the through-holes located at the central portion by an area of the central portions.

According to another aspect of the present disclosure, a water heater includes a burner including a mixing chamber, in which a fuel and air are mixed to generate a mixture, and a plate-shaped distribution plate that generates a combustion reaction when the mixture is ejected, a combustion chamber configured such that flames generated through the combustion reaction are located in an interior thereof, a heat exchanger that heats water by using heat generated through the combustion reaction, and a combustion chamber heat insulating pipeline configured such that water flows to an outside of the combustion chamber for heat-insulating the combustion chamber, when a direction, in which the combustion gas generated through the combustion reaction flows, is defined as a reference direction, one direction that is perpendicular to the reference direction is defined as a lengthwise direction, and a direction that is perpendicular to the reference direction and the lengthwise direction is defined as a widthwise direction, a plurality of through-holes are disposed in the distribution plate along the reference direction to be spaced apart from each other along the lengthwise direction and the widthwise direction such that the mixture pass therethrough, and the distribution plate includes a central portion located at a center with respect to the widthwise direction, and outskirt portions located on opposite sides of the central portion, and the through-holes formed at the outskirt portions are disposed such that outer distal ends of flames formed by the mixture passing through the through-holes disposed at the outskirt portions with respect to the widthwise direction are located on an inner side of a portion of a side wall of the combustion chamber, which contacts the combustion chamber heat insulating pipeline.

Advantageous Effects

Accordingly, the combustion performance of the burner may be improved whereby a combustion reaction that neither causes incomplete combustion nor generates carbon monoxide that is a by-product thereof may be possible.

MODE FOR INVENTION

Figure 1:
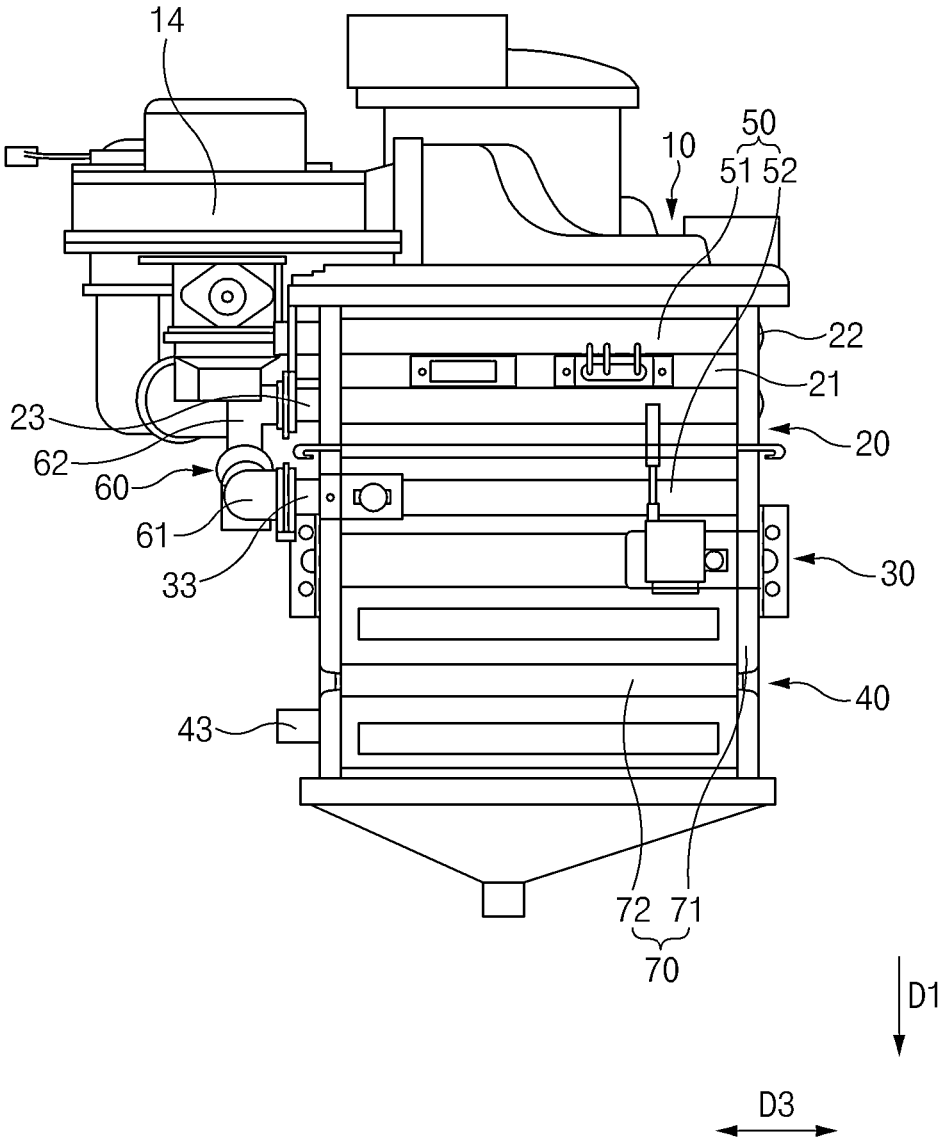
FIG. 1 is a perspective view illustrating a water heater according to a first embodiment of the present disclosure.

Hereinafter, embodiments of the present disclosure will be described in detail with reference to the accompanying drawings. In adding reference numerals to the components of the drawings, it is noted that the same components are denoted by the same reference numerals even when they are drawn in different drawings. Furthermore, in describing the embodiments of the present disclosure, when it is determined that a detailed description of related known configurations and functions may hinder understanding of the embodiments of the present disclosure, a detailed description thereof will be omitted.

Furthermore, in describing the components of the embodiments of the present disclosure, terms, such as first, second, "A", "B", (a), and (b) may be used. The terms are simply for distinguishing the components, and the essence, the sequence, and the order of the corresponding components are not limited by the terms. When it is described that a component is "connected to", "coupled to", or "electrically connected to" another component, it should be understood that the former component may be directly connected to, fastened to, or connected to the latter component, but a third component may be "connected", "coupled", or "electrically connected" between the components.

Figure 2:
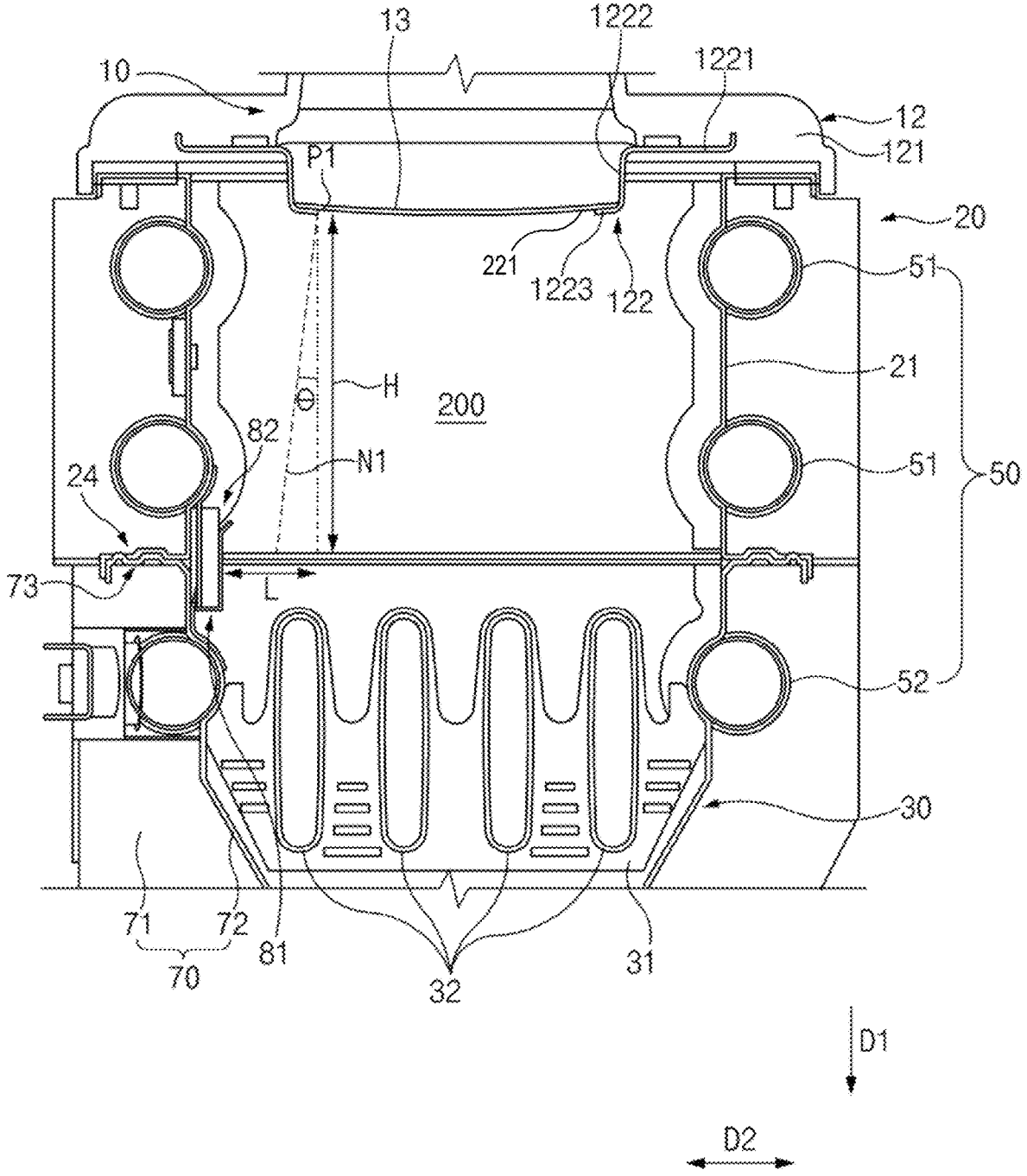
FIG. 2 is a view illustrating a portion of a longitudinal section of a water heater according to a first embodiment of the present disclosure.

FIG. 1 is a perspective view illustrating a water heater 1 according to a first embodiment of the present disclosure. FIG. 2 is a view illustrating a portion of a longitudinal section of the water heater 1 according to the first embodiment of the present disclosure.

A direction, in which a combustion gas generated through a combustion reaction flows, is defined as a reference direction D1, one direction that is perpendicular to the reference direction D1 is defined as a lengthwise direction D3, and a direction that is perpendicular to the reference direction D1 and the lengthwise direction D3 is defined as a widthwise direction D2.

Components may be arranged along the reference direction D1. Here, the reference direction D1 may be a downward direction. In the specification, the reference direction D1, the widthwise direction D2, and the lengthwise direction D3 are referred for convenience of description. The directions may be determined relative to a direction, in which the water heater 1 is arranged.

The water heater 1 according to the first embodiment of the present disclosure may have a burner 10, a combustion chamber 20, and heat exchangers 30 and 40 in a sequence thereof along the reference direction D1. Accordingly, the combustion gas generated in the burner 10 may flow downwards, and may be discharged via the combustion chamber 20 and the heat exchangers 30 and 40. The heat exchangers 30 and 40 may include the latent heat exchanger 40 and the sensible heat exchanger 30, and the sensible heat exchanger 30 may be disposed in an interior of the combustion chamber 20.

Combustion Chamber 20

The water heater 1 according to the first embodiment of the present disclosure may include the combustion chamber 20. Flames due to the combustion reaction that is generated by the burner 10 may be located in an interior of the combustion chamber 20. The combustion chamber 20 may have a shape like a box, upper and lower sides of which are opened, and the burner 10 may be connected to an upstream side with respect to the reference direction D1, and the heat exchangers 30 and 40 may be connected to a downstream side thereof. Accordingly, the combustion gas may be generated in the burner 10, and may be delivered to the sensible heat exchanger 30 and the latent heat exchanger 40 via the combustion chamber 20.

The combustion chamber 20 may have side walls 21. The side walls 21 of the combustion chamber 20 may include two general side plates that are spaced apart from each other along the lengthwise direction D3, and two heat insulating side plates that are spaced apart from each other along the widthwise direction D2. The general side plates and the heat insulating side plates may be coupled to each other to define a combustion space 200. Passage cap plates 22 each including a passage cap that is a part that protrudes to an outside of the combustion chamber 20 may be coupled to outsides of the general side plates along the lengthwise direction D3, respectively. Accordingly, a space, in which water may flow, may be defined between the general side plates and the passage caps, and the space may be communicated with adjacent heat insulating pipelines or adjacent sensible heat exchange pipelines 32, which will be described below, to define a portion of the heat insulating passage including the heat insulating pipelines and the sensible heat passage including the sensible heat exchange pipelines 32.

Heat Exchangers 30 and 40

The heat exchangers 30 and 40 heat water by using heat generated through the combustion reaction. The heat exchangers 30 and 40 may be divided into the sensible heat exchanger 30 and the latent heat exchanger 40 according to which heat is used.

Each of the heat exchangers 30 and 40 may have a housing 70. The housing 70 of the heat exchangers 30 and 40 may include two heat exchanging general side plates 71 that are spaced apart from each other along the lengthwise direction D3, and two heat exchanging/heat insulating side plates 72 that are spaced apart from each other along the widthwise direction D2. The heat exchanging general side plates 71 and the heat exchanging/heat insulating side plates 72 may be coupled to each other to define an interior space of the housing 70. Heat exchanging passage cap plates each including a passage cap that is a part that protrudes to an outside of the heat exchangers 30 and 40 may be coupled to outsides of the heat exchanging general side plates 71 along the lengthwise direction D3. Accordingly, a space, in which water may flow, may be formed between the heat exchanging general side plates 71 and the passage caps, and the space may be communicated with at least one of the adjacent sensible heat insulating pipelines 52, the adjacent sensible heat exchange pipelines 32, and the adjacent latent heat exchange pipelines to define at least one of a portion of the sensible heat passage including the sensible heat exchange pipelines 32 and a portion of the latent heat passage including the latent heat exchange pipelines.

At least a portion of the sensible heat exchanger 30 may be inserted into the combustion chamber 20. The sensible heat exchanger 30 may be disposed in an interior of the combustion chamber 20. Accordingly, a sensible heat fin 31 that will be described below may contact an inner surface of the combustion chamber 20. The sensible heat exchanger 30 may be disposed at a lower portion of the combustion space 200 that is an interior space of the combustion chamber 20. Flames by the burner 10 may be located at an upper portion of the combustion space 200.

The water heater 1 according to the first embodiment of the present disclosure may include a heat insulating pipeline 50, and the heat insulating pipeline 50 may include a combustion chamber heat insulating pipeline 51. The heat insulating pipeline 50 may include a sensible heat insulating pipeline 52. The sensible heat insulating pipeline 52 may be disposed to be adjacent to an outside of the heat insulating side plate with respect to the widthwise direction D2. Water may flow in an interior of the heat insulating pipeline 50 to heat-insulate the combustion chamber 20 and the sensible heat exchanger 30. The combustion chamber heat insulating pipeline 51 may heat-insulate the combustion chamber 20, and the sensible heat insulating pipeline 52 may heat-insulate the sensible heat exchanger 30. The heat insulating pipeline 50 may include a latent heat insulating pipeline that is disposed to be adjacent to the latent heat exchanger 40 from an outside of the latent heat exchanger 40. The water may flow in an interior of the latent heat insulating pipeline to heat-insulate the latent heat exchanger 40.

The sensible heat insulating pipeline 52 may be disposed to be adjacent to the sensible heat exchanger 30. However, because the sensible heat insulating pipeline 52 contacts an outer surface of the heat exchanging/heat insulating side plate 72, the sensible heat insulating pipeline 52 may be disposed at a location that is opposite to the sensible heat exchanger 30 with respect to the heat exchanging/heat insulating side plate 72. For this disposition, a portion of the sensible heat insulating pipeline 52 may be disposed at a height that is similar to that of the sensible heat exchanger 30 with respect to the upward/downward direction to overlap the sensible heat exchanger 30 with respect to the widthwise direction D2 on a cross-section taken along a plane that is perpendicular to the lengthwise direction D3.

The sensible heat exchanger 30 is configured to receive the heat generated through the combustion reaction generated in the burner 10 and heat the water that flows in an interior thereof. It is described that the sensible heat exchanger 30 according to an embodiment of the present disclosure is a fin-tube type heat exchanger, but another type of heat exchanger, such as a plate-shaped heat exchanger, may be used as the sensible heat exchanger.

The sensible heat exchanger 30 may include the sensible heat exchange pipeline 32 and the sensible heat fin 31. The sensible heat exchange pipeline 32 is a pipeline that is configured to receive the heat generated through the combustion reaction and heat the water that flows through an interior thereof. The water may flow in the interior of the sensible heat exchange pipeline 32, and the combustion gas may flow therearound such that they exchange heat by a medium of the sensible heat exchange pipeline 32.

The sensible heat exchange pipeline 32 may extend along the lengthwise direction D3, and may be arranged along the widthwise direction D2. Opposite ends of the sensible heat exchange pipeline 32 may be communicated with the space defined by the passage caps as described above to define the sensible heat passage. Among the sensible heat exchange pipelines 32, one of the sensible heat exchange pipelines 32 located at the opposite ends along the widthwise direction D2 may be connected to the latent heat exchanger 40 to function as an inlet of the sensible heat passage, and the other one may be connected to the sensible heat insulating pipeline 52 to function as an outlet of the sensible heat passage.

In a cross-section of the sensible heat exchange pipeline 32, taken along a plane that is perpendicular to the lengthwise direction D3, in which the sensible heat exchange pipeline 32 extends, a shape of an interior space of the sensible heat exchange pipeline 32 may be a slotted shape that extends along the upward/downward direction. The interior space of the sensible heat exchange pipeline 32 may have a shape, in which a value that is obtained by dividing a length thereof along the upward/downward direction on the cross-section by a width thereof along the widthwise direction D2 is 2 or more.

The sensible heat fin 31 may have a plate shape that is perpendicular to a direction, in which the sensible heat exchange pipeline 32 extends. A plurality of sensible heat fins 31 may be provided, and may be passed through by the sensible heat exchange pipelines 32. The sensible heat exchanger 30 may increase a heat transfer area by using the sensible heat fins 31.

An upper portion of the sensible heat fin 31 may be formed along the sensible heat exchange pipeline 32, and may protrude upwards. Louver holes that are opened along the lengthwise direction D3, and louvers that protrudes from circumferences of the louver holes along the lengthwise direction D3 may be formed at a lower portion of the sensible heat fins 31 whereby the flows of the combustion gas may be guided to peripheries of the sensible heat exchange pipelines 32.

The sensible heat insulating pipelines 52 may be connected to the combustion chamber heat insulating pipelines 51 to connect the sensible heat passages to the combustion chamber passages that are defined by the combustion chamber heat insulating pipelines 51. However, the sensible heat exchange pipelines 32 and the combustion chamber heat insulating pipelines 51 may be directly connected to each other such that the combustion chamber passages and then sensible heat passages are connected to each other.

The latent heat exchanger 40 is disposed on a downstream side of the sensible heat exchanger 30 with respect to the reference direction D1, and is configured to heat the water that flows through an interior thereof by using the latent heat of the combustion gas that is generated through the combustion reaction and flows. The combustion gas may be delivered to the latent heat exchanger 40 via the sensible heat exchanger 30. The water may be heated first in the latent heat exchanger 40, and may be heated secondarily by the sensible heat exchanger 30. Accordingly, the heat exchange pipelines included in the latent heat exchanger 40 may be communicated with the sensible heat exchange pipelines 32 of the sensible heat exchanger 30 to deliver the heated water to the sensible heat exchanger 30.

The latent heat exchanger 40 may be a plate-shaped heat exchanger that is formed by stacking a plurality of latent heat plates, and may be a fin-tube type heat exchanger including heat exchange pipelines and fins that are passed through by the heat exchange pipelines, similarly to the sensible heat exchanger 30, but the kinds thereof are not limited thereto.

The water may be delivered to a heating pipeline that is located in a heating target that requires heating of an outside to perform heating. After the heat is delivered to the heating target, a closed circuit, in which the water may return to the water heater 1 and circulate, may be formed. Furthermore, the water may be delivered to a hot water heat exchanger through a circulation pipeline to be used to generate hot water.

A plurality of combustion chamber heat insulating pipelines 51 may be provided. In FIG. 2, the plurality of combustion chamber heat insulating pipelines are adjacent to the left and right sides of the combustion chamber 20 and may be disposed to be spaced vertically apart from each other. The drawing illustrates that a total of four combustion chamber heat insulating pipelines 51 are disposed, two combustion chamber heat insulating pipelines 51 are disposed on a left side of the combustion chamber 20 to be spaced vertically apart from each other, and two combustion chamber heat insulating pipelines 51 are disposed on a right side of the combustion chamber 20 to be spaced vertically apart from each other.

A lower end of, among the combustion chamber heat insulating pipelines 51, the combustion chamber heat insulating pipeline 51 located on a lowermost side may be located on an upper side of an upper end of the sensible heat fins 31 included in the sensible heat exchanger 30. Then, a distance from a lower end of the burner 10 to upper ends of the sensible heat fins 31 may be not less than 80 mm and not more than 85 mm. Through the configuration, carbon monoxide quenching phenomenon may be reduced.

The carbon monoxide quenching phenomenon means a phenomenon, in which carbon monoxide generated through combustion fails to meet oxygen in a high-temperature area in the combustion chamber 20, to be converted into carbon dioxide, and to be discharged, and the carbon monoxide is discharged as it is while contacting the sensible heat exchanger 30 having a relatively low temperature.

The combustion chamber heat insulating pipeline 51 may contact an outer surface of the heat insulating side plate of the combustion chamber to heat-insulate the combustion chamber 20. An amount of the heat generated through the combustion reaction and delivered to an external area of the combustion chamber 20 through the side wall 21 may be reduced as heating water flows through the combustion chamber heat insulating pipeline 51.

A portion of the heat insulating side plate, which is a portion of the side wall 21 which the combustion chamber heat insulating pipeline 51 contacts, may have a shape that protrudes convexly inwards to correspond to an external appearance of the combustion chamber heat insulating pipeline 51. Accordingly, as compared with the case, in which the heat insulating side plate has a simple plate shape, outer surfaces of the combustion chamber heat insulating pipelines may contact the heat insulating side plate over a wider area.

The combustion chamber passage may include at least one of a part that is formed in parallel and a part that is formed in series. The combustion chamber passage that insulates the combustion space 200 as water flows around the combustion space 200 may be formed by connecting the passage cap formed in the passage cap plate 22 and the combustion chamber heat insulating pipeline 51.

Adapter 60

The water heater 1 according to a first embodiment of the present disclosure may include an adapter 60. The adapter 60 may connect the sensible heat passage and the combustion chamber passage. The adapter may connect an outlet of the sensible heat passage and an inlet of the combustion chamber passage. The outlet of the sensible heat passage, as described above, may be defined by a distal end of one of the sensible heat exchange pipelines 32, may be defined by a distal end of one of the sensible heat exchange pipelines 32 and the passage cap connected thereto, and may be defined by a distal end of one of the sensible heat insulating pipelines 52. The inlet of the combustion chamber passage may be defined by a distal end of one of the combustion chamber heat insulating pipelines 51, or may be defined by a distal end of one of the combustion chamber heat insulating pipelines 51 and the passage cap connected thereto.

The adapter 60 may be coupled to a heating water discharge hole 33 and a combustion chamber supply hole 23 to be separable. The heating water discharge hole 33 may be an inlet of the sensible heat passage or may be a distal end of the sensible heat insulating pipeline 52. The combustion chamber supply hole 23 is an inlet of the combustion chamber passage. The heating water discharge hole 33 and the combustion chamber supply hole 23 may protrude outwards from the heat exchangers 30 and 40 and the combustion chamber 20. To couple the heating water discharge hole 33 and the combustion chamber supply hole 23 such that they are separable, the heating water discharge hole 33 and the combustion chamber supply hole 23 may be disposed in the same direction of the water heater 1 with respect to a third direction.

The adapter 60 may have an adapter heat exchanger part 61 and an adapter combustion chamber side part 62 that are connected to each other, on upper and lower sides, and the heating water discharge hole 33 and the combustion chamber supply hole 23 may be connected to each other as they are connected to the heating water discharge hole 33 and the combustion chamber supply hole 23. The adapter heat exchanger part 61 may have an adapter heat exchanger-side connecting part that is one end, to which the heating water discharge hole 33 is coupled, and the adapter combustion chamber side part 62 may have an adapter combustion chamber-side connecting part, to which the combustion chamber supply hole 23 is coupled.

The adapter 60 may include an adapter O-ring. The adapter O-ring is a member that is disposed between the adapter heat exchanger part 61 and the adapter combustion chamber side part 62 in an area, in which the adapter heat exchanger part 61 and the adapter combustion chamber side part 62 are connected to each other, and may have elasticity to maintain a sealing state between the adapter heat exchanger part 61 and the adapter combustion chamber side part 62.

The adapter heat exchanger part 61 may be inserted into the adapter combustion chamber side part 62 to be coupled thereto. This is for preventing the heating water from being directly leaked even though the adapter O-ring fails to maintain a sealing state when the heating water flows through the adapter 60.

An adapter clip may be disposed at portions, at which the adapter heat exchanger part 61 and the adapter combustion chamber side part 62 are coupled to each other, and may press them inwards to firmly couple them. Furthermore, a separate clip may be disposed at a portion, at which the adapter 60 is coupled to the heating water discharge hole 33 and the combustion chamber supply hole 23, to couple them more firmly.

The adapter heat exchanger part 61 and the adapter combustion chamber side part 62 may have a shape that is bent in "L" shape. Accordingly, the adapter 60 that is formed by coupling two members may have an angled "U" shape.

An elbow pipe instead of the adapter 60 may be disposed to connect the heating water discharge hole 33 and the combustion chamber supply hole 23.

Side Plate Packing 82

According to the first embodiment of the present disclosure, inside the water heater 1, a side plate packing 82 that is disposed at a location between the sensible heat insulating pipelines 52 and the combustion chamber heat insulating pipelines 51 may be included in the water heater 1 to contact an inner surface of the housing 70. The side plate packing 82 may further extend toward the combustion chamber 20 to further contact an inner surface of the side wall 21.

Areas between the sensible heat insulating pipelines 52 and the combustion chamber heat insulating pipelines 51 are neither heat-insulated nor cooled, and thus there is a danger of overheating. When the combustion chamber 20 is heat-insulated by using an insulator, a danger of overheating may be made relatively low as the overheating possible area is covered by the insulator. However, when the overheating possible area is exposed as in the first embodiment of the present disclosure, it may be decolored due to overheating. To prevent this, the side plate packing 82 may be disposed in the overheating possible area to contact it to restrain heat from being delivered to the housing 70.

The water heater 1 may further include a packing bracket 81. The packing bracket 81 is a bracket that sandwiches and supports the side plate packing 82 and an inner surface of the housing 70 such that the side plate packing 82 contacts the inner surface of the housing 70. That is, the side plate packing 82 may be interposed between the inner surface of the housing 70 and the packing bracket 81. A distal end of the packing bracket 81 may be formed to be inclined to an inside of the combustion space 200 as it goes upwards, and may guide the side plate packing 82 when the side plate packing 82 is inserted into a space formed between the packing bracket 81 and the housing 70.

The packing bracket 81 and the side plate packing 82 may meet the sensible heat insulating pipelines 52 while the housing 70 being interposed therebetween. The packing bracket 81 that indirectly contacts the sensible heat insulating pipelines 52 may be cooled by the sensible heat insulating pipelines 52 to help an operation of the side plate packing 82 that obstructs transfer of heat to the overheating possible area.

Burner 10

The burner 10 is configured to cause the combustion reaction by using air and a fuel. Accordingly, the burner 10 may include a mixing chamber 11, an ignition plug, a blower 14, a fuel pump, a fixing frame 12, and a distribution plate 13.

The blower 14 receives electric power to be operated and is configured to pump air at a specific pressure. Accordingly, the blower 14 may include an impeller and a motor, but the components that constitute the blower 14 are not limited thereto. The fuel pump may pump and supply a fuel to the mixing chamber 11.

The mixing chamber 11 is a component that receives air from the blower 14 and receives a fuel to form a mixture, and may cover an opening that is formed on an upstream side of the combustion chamber 20 along the reference direction D1. The fixing frame 12 that has an opening at a center thereof may be coupled to a downstream side of the mixing chamber 11 along the reference direction D1. The fixing frame 12 may be located between the combustion chamber 20 and the mixing chamber 11.

The fixing frame 12 may include a frame cover 121. The fixing frame 12 may include a frame bracket 122. The frame cover 121 may be fixed between the mixing chamber 11 and the combustion chamber 20, and the frame cover 121 may cover an upper end of the combustion chamber 20. The frame bracket 122 may be coupled to the frame cover 121. A portion of the frame bracket 122 may be exposed to an inside of the combustion chamber 20.

The frame bracket 122 may include a bracket fixing part 1221. The bracket fixing part 1221 may be located on an outermost side of the frame bracket 122 with respect to the widthwise direction D2 and the lengthwise direction D3, and may be coupled to the frame cover 121. The bracket fixing part 1221 may be inserted into and fixed to an inside of the frame cover 121. The bracket fixing part 1221 may be coupled to the frame cover 121 through a fastening member. The bracket fixing part 1221 may be formed to extend in the widthwise direction D2 and the lengthwise direction D3.

The frame bracket 122 may include a bracket connecting part 1222. The bracket connecting part connects the bracket fixing part 1221 and a bracket stopping part 1223. The bracket connecting part 1222 may have a side surface that extends in the reference direction D1 and the lengthwise direction D3 and a side surface that extends in the reference direction D1 and the widthwise direction D2 to connect an inner end of the bracket fixing part 1221 and an outer end of the bracket stopping part 1223.

The frame bracket 122 may include a bracket stopping part 1223. The bracket stopping part 1223 that surrounds an opening at the center and is included in the burner frame 21 may be formed. An outer part of the distribution plate 13 are coupled to the bracket stopping part 1223. The outer part of the distribution plate 13 may mean opposite ends of the distribution plate 13 in the widthwise direction D2 and the lengthwise direction D3. The bracket stopping part 1223 may be formed to surround a combustion area that is formed in the distribution plate 13. The bracket stopping part 1223 may extend along the widthwise direction D2 and the lengthwise direction D3 to fix the distribution plate 13 at an inside thereof in a state, in which the distribution plate 13 covers and closes an opening that is formed at a center of the bracket stopping part 1223, and may extend obliquely in an intermediate direction of the widthwise direction D2 and the lengthwise direction D3, and the reference direction D1.

When viewed from the combustion space 200 that is an interior space of the combustion chamber 20 along an opposite direction to the reference direction D1, an area formed at a circumference of the distribution plate 13 is covered by the bracket stopping part 1223, and at least a portion of the combustion area is exposed. Accordingly, the combustion area may be formed from an outer point P1 located at a border of an inner end of the bracket stopping part 1223 and a lower surface 221 of the distribution plate 13, and flames accompanying the combustion reaction may extend to the combustion space 200.

The combustion reaction occurs on a surface located on a most downstream side of the distribution plate 13 with respect to the reference direction D1, and the flames extend. Let's define an area of the distribution plate 13, in which the combustion reaction occurs, as the combustion area in this way. A mixture is burned and flames are generated in the combustion area, and no flames are generated to extend to the combustion space 200 at another point other than the combustion area. The combustion area may be provided such that a normal line N1 drawn from an arbitrary point of the combustion area does not contact an inner surface of the combustion chamber 20. As illustrated, the combustion area may be provided such that the normal line N1 does not reach the side plate packing 82. The normal line N1 drawn from the arbitrary point of the combustion area may contact an upstream side of the heat exchangers 30 and 40 with respect to the reference direction D1 before contacting an inner surface of the combustion chamber 20.

Here, the normal line N1 means a line that, when an imaginary tangent plane is formed at one point that is present in the curved combustion area, is perpendicular to the tangent plate and passes the one point. As in the first embodiment of the present disclosure, in the case of the combustion area that is formed by, on a plane, extending a specific shape in a direction that is perpendicular to the plane, a line that is perpendicular to a tangential line drawn from the outer point P1 that is one point having the specific shape on the plane and passes through the one point is the normal line N1.

Because the normal line N1 drawn from the combustion area does not contact the inner surface of the combustion chamber 20, the flames formed in the combustion area do not contact the inner surface of the combustion chamber 20 or may have a very mere influence even though it contacts the inner surface of the combustion chamber 20. Accordingly, a portion of a calorie of the heat accompanied by the frames, which is delivered to the side plate of the combustion chamber 20 is reduced, and thus the combustion chamber 20 may be prevented from being excessively overheated.

The distribution plate 13, as illustrated, may be a curved surface that is formed by extending a profile that is formed to be convex from one cross-section along the reference direction D1, in a direction that is perpendicular to the one cross-section. The direction that is perpendicular to the one cross-section may be the lengthwise direction D3.

Due to the shape of the combustion area, the direction, in which the normal line N1 extends from an arbitrary point of the combustion area, is not changed as it goes along the lengthwise direction D3 but is changed as it goes along the widthwise direction D2.

The combustion area may be configured such that the normal line N1 drawn from the outer point P1 located on an outermost side with respect to the widthwise direction D2 is prevented from contacting the inner surface of the combustion chamber 20. Let's define a size of an astute angle that is defined by a line that extends from the outer point P1 of the combustion area in parallel to the reference direction D1 and the normal line N1 at the outer point P1 as θ. Let's define a distance from the outer point P1, at which the normal line N1 is formed, to the inner surface of the combustion chamber 20 along the widthwise direction D2 as "L", and a distance from the outer point P1, at which the normal line N1 is formed, to a point located on a most downstream side of the inner surface of the combustion chamber 20 along the reference direction D1 as "H". In this situation, the burner 10 may be configured such that the combustion area and the inner surface of the combustion chamber 20 satisfy Mathematic formula 1 that is an inequality.

$$\tan\Theta < \frac{L}{H} \qquad \text{[Mathematic formula 1]}$$

In the description of the first embodiment, a relationship between an angle and a length of the normal line N1 at the outer point P1 has been described, but the burner 10 may be configured such that the same equality is satisfied at an arbitrary point other than the outer point P1.

The ignition plug is configured to generate a spark in the mixture formed by mixing the air and the fuel in the mixing chamber 11 for ignition.

The distribution plate 13 is configured to fix the ignited flames. The distribution plate 13 may have a plate shape. The combustion reaction may occur while the mixture is ejected through the distribution plate 13. Opposite ends of the distribution plate 13 in the widthwise direction D2 and the lengthwise direction D3 may be coupled to the fixing frame 12, and the distribution plate 13 may be disposed to open and close the opening of the fixing frame 12. A mat that is formed by densely weaving metal fibers such that the flames are fixed may be disposed on a downstream side of the distribution plate 13 along the reference direction D1.

Figure 3:
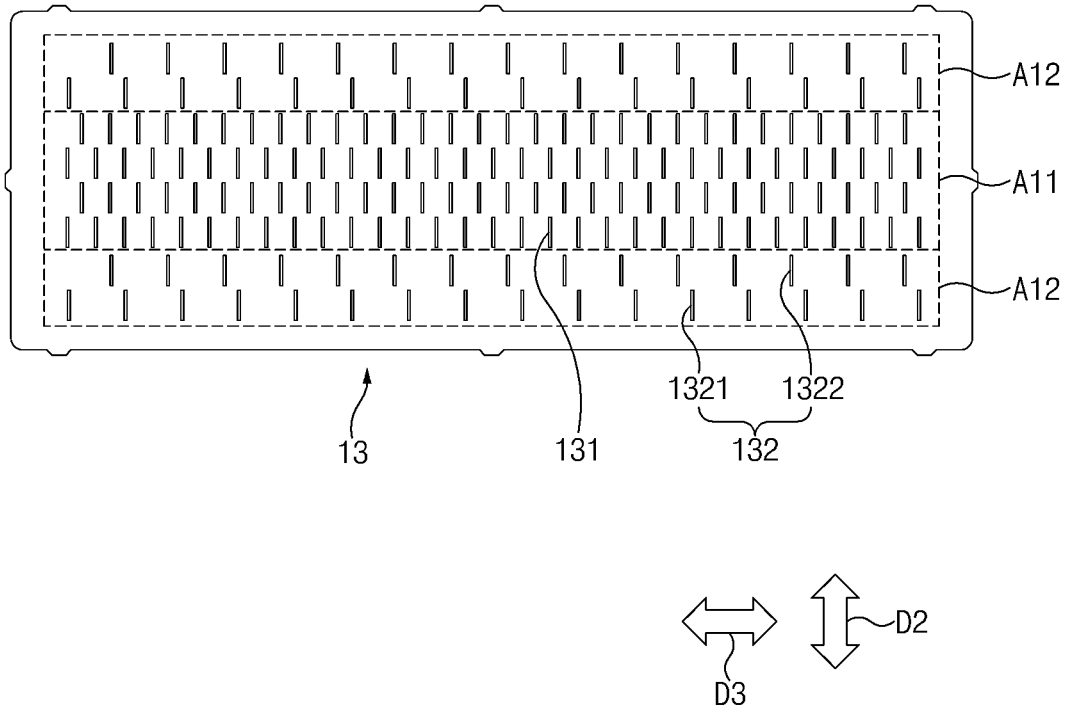
FIG. 3 is a view illustrating a shape of a distribution plate of a burner having through-holes according to a first embodiment of the present disclosure.

FIG. 3 is a view illustrating a shape of the distribution plate 13 of the burner 10 according to the first embodiment of the present disclosure.

The distribution plate 13 may be passed through along the reference direction D1 such that the mixture passes therethrough whereby a plurality of through-holes 131 and 132 are formed. The plurality of through-holes 131 and 132 may be disposed on the distribution plate 13 to be spaced apart from each other in the lengthwise direction D3 and the widthwise direction D2. The through-holes 131 and 132 may have slit shapes that extend along the widthwise direction D2. One through-hole row may be formed by grouping the through-holes 131 and 132 that are disposed at the same location along the widthwise direction D2 and are disposed to be spaced apart from each other at a specific spacing interval. A plurality of through-hole rows may be formed along the widthwise direction D2. The through-holes 131 and 132 included in the one through-hole row may have the same spacing interval, and the through-holes 131 and 132 included in another through-hole row may have another spacing interval.

The distribution plate 13 includes a central portion A11 that is located at a center with respect to the widthwise direction D2, and outskirt portions A12 that are located on opposite sides or the central portion A11. That is, the outskirt portions A12 may be divided into two parts that are divided by the central portion A11. The through-holes 131 and 132 located at the outskirt portions A12 refer to the outskirt through-holes 132, and the through-holes 131 and 132 located at the central portion A11 refers to the central through-holes 131. A sum of the widths of the outskirt portions A12 with respect to the widthwise direction D2 may be equal to or smaller than the width of the central portion A11.

A penetration density obtained by dividing the sum of the areas of the outskirt through-holes 132 by the area of the outskirt portion A12 may be smaller than a penetration density obtained by dividing the sum of the areas of the central through-holes 131 by the area of the central portion A11. The penetration density of the outskirt portion A12 may be 70% or less of the penetration density of the central portion A11. Accordingly, an amount of the mixture that passes through the distribution plate 13 may be concentrated at the central portion A11 than at the outskirt portions A12, and thus strong flames may be formed at the central portion A11.

The outskirt through-holes 132 may be disposed such that outer distal ends of the flames formed by the mixture that passes through the outskirt through-holes 132 with respect to the widthwise direction D2 are located on an inner side of a portion of the side wall 21 of the combustion chamber 20, which contacts the combustion chamber heat insulating pipelines 51. That is, by reducing a size of the outskirt portions of the formed flames to prevent the frames from directly contacting the combustion chamber heat insulating pipelines 51 or the side wall 21 of the combustion chamber 20, incomplete combustion due to overheating may be prevented and flames may be prevented from flying.

The spacing interval of the through-hole rows disposed in the central portion A11 and the spacing interval of the through-hole rows disposed at the outskirt portions A12 may be different. The spacing interval of the through-hole rows disposed in the central portion A11 may be smaller than the spacing interval of the through-hole rows disposed at the outskirt portions A12.

The outskirt through-holes 132 may include outer through-holes 1321 disposed on an outermost side with respect to the widthwise direction D2, and inner through-holes 1322 disposed on an inner side of the outer through-holes 1321. The outer through-holes 1321 and the inner through-holes 1322 may be disposed to be spaced apart from each other alternately along the lengthwise direction D3 when viewed along the widthwise direction D2. The outer through-holes 1321 and the inner through-holes 1322 may be disposed to be spaced apart from each other by a first interval and a second interval alternately. Accordingly, the outskirt through-holes 132 may be disposed such that one outer through-hole 1321 and the inner through-hole 1322 may be located adjacent to each other and another outer through-hole 1321 and another inner through-hole 1322 are located at locations that are spaced apart from each other by a specific spacing interval.

The number of the outskirt through-holes 132 may be smaller than the number of the central through-holes 131. The sum of the areas of the outskirt through-holes 132 may be smaller than the sum of the areas of the central through-holes 131.

In the first embodiment of the present disclosure, widths of the two outskirt portions A12 is 25% of the width of the distribution plate 13, respectively, and the width of the central portion A11 is 50% of the width of the distribution plate 13. In the first embodiment of the present disclosure, the number of the central through-holes 131 is two times the number of the outskirt through-holes 132. In the first embodiment of the present disclosure, the sum of the areas of the outskirt through-holes 132 is 33.6% of the sum of the areas of all of the through-holes 131 and 132, and the sum of the areas of the central through-holes 131 is 66.3% of the areas of all of the through-holes 131 and 132.

Figure 4:
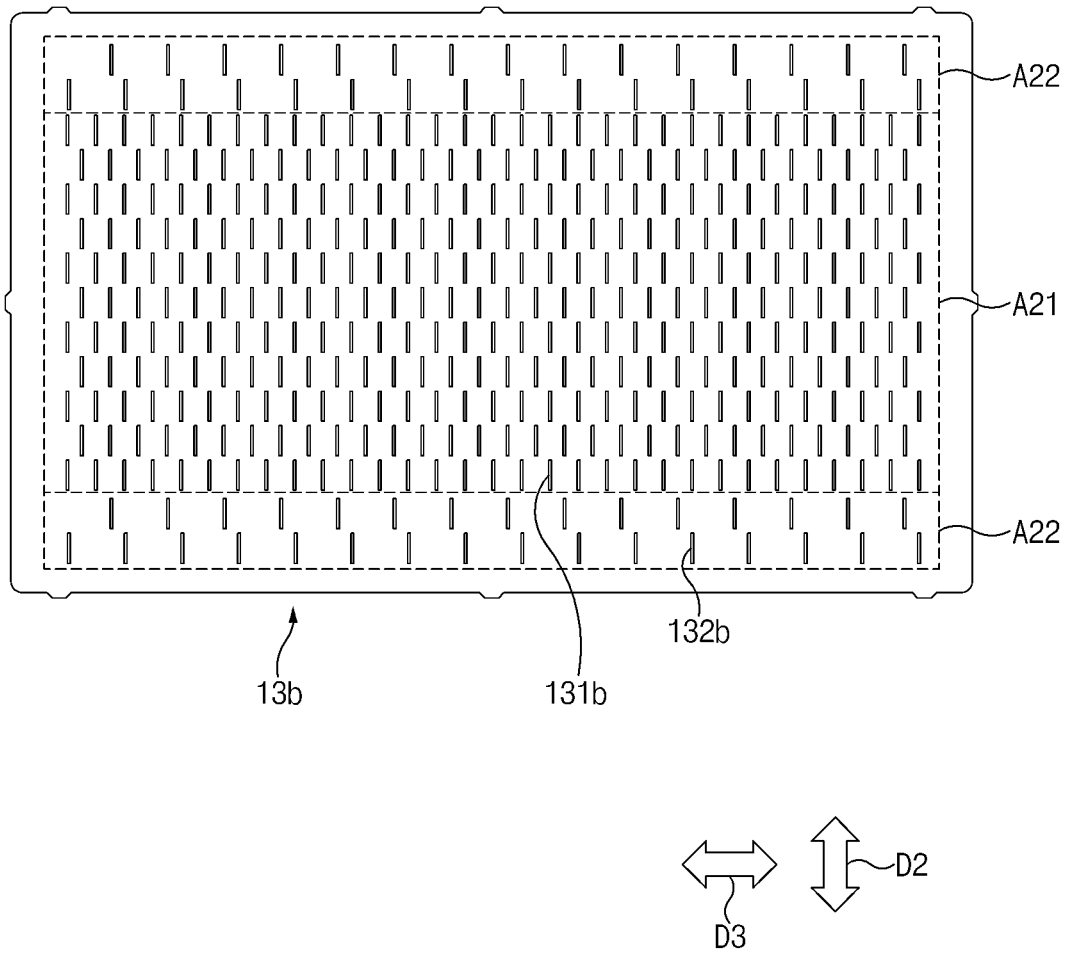
FIG. 4 is a view illustrating a shape of a distribution plate of a burner according to a second embodiment of the present disclosure.

FIG. 4 is a view illustrating a shape of the distribution plate of the burner according to a second embodiment of the present disclosure.

A shape of a distribution plate 13*b* according to the second embodiment of the present disclosure is different from a shape of the distribution plate 13 of the burner 10 according to the first embodiment in detailed sizes. The contents of the water heater 1 according to the first embodiment may be directly applied to the remaining components of the water heater according to the second embodiment, except for a shape of the distribution plate 13*b* of the burner according to the second embodiment. In detail, in the second embodiment of the present disclosure, the widths of outskirt portions A22 is 13.3% of the width of the distribution plate 13*b*, respectively, and the width of a central portion A21 is 73.4% of the distribution plate 13*b*. In the second embodiment of the present disclosure, the number of central through-holes 131*b* is 5.5 times of the number of outskirt through-holes 132*b*. In the second embodiment of the present disclosure, the sum of the areas of the outskirt through-holes 132*b* is 15.4% of the sum of the areas of all of the through-holes 131*b* and 132*b*, and the sum of the areas of the central through-holes 131*b* is 84.6% of the areas of all of the through-holes 131*b* and 132*b*. The number of the through-hole rows of the central portion A21 of the second embodiment is larger than the number of the through-hole rows of the central portion A11 of the first embodiment.

Figure 5:
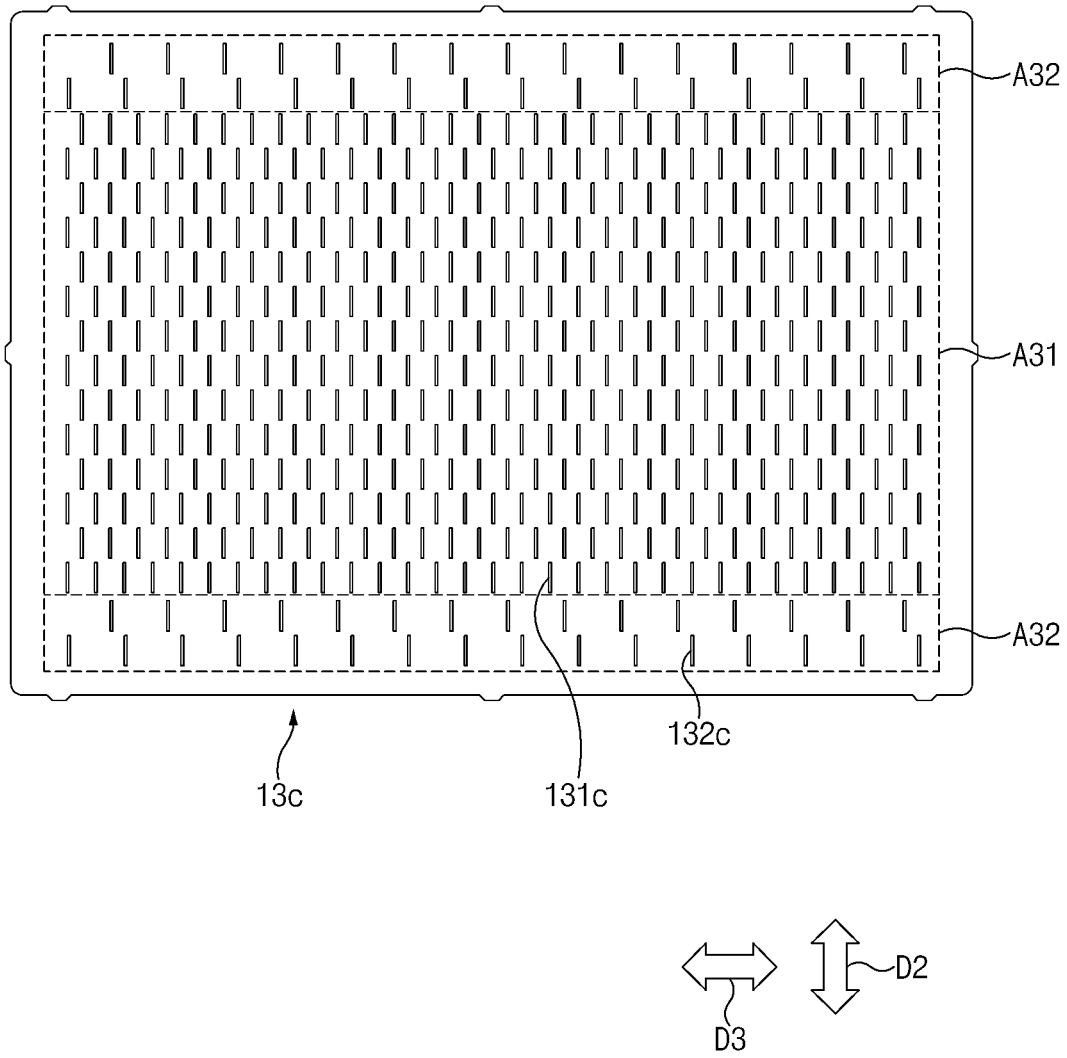
FIG. 5 is a view illustrating a shape of a distribution plate of a burner according to a third embodiment of the present disclosure.

FIG. 5 is a view illustrating a shape of a distribution plate of a burner according to a third embodiment of the present disclosure.

A shape of a distribution plate 13*c* according to the third embodiment of the present disclosure is different from a shape of the distribution plate according to the first embodiment and the second embodiment in detailed sizes. The contents of the water heater 1 according to the first embodiment may be directly applied to the remaining components of the water heater according to the second embodiment, except for a shape of the distribution plate 13*c* of the burner according to the third embodiment. In detail, in the third embodiment of the present disclosure, the widths of outskirt portions A32 is 9.5% of the width of the distribution plate 13*c*, respectively, and the width of a central portion A31 is 81.0% of the distribution plate 13*c*. In the third embodiment of the present disclosure, the number of central through-holes 131*c* is 8.5 times of the number of outskirt through-holes 132*c*. In the third embodiment of the present disclosure, the sum of the areas of the outskirt through-holes 132*c* is 10.6% of the sum of the areas of all of the through-holes 131*c* and 132*c*, and the sum of the areas of the central through-holes 131*c* is 89.4% of the areas of all of the through-holes 131*c* and 132*c*.

That is, the widths of the outskirt portions A12, A22, and A32 of the burner according to the embodiments of the present disclosure may be not less than 9.5% and not more than 25% of the widths of the distribution plates 13, 13*b*, and 13*c*, respectively, and the widths of the central portions A11, A21, and A31 may be not less than 50% and not more than 81% of the distribution plates 13, 13*b*, and 13*c*. Furthermore, the numbers of central through-holes 131, 131*b*, and 131*c* of the burner according to the embodiments of the present disclosure may be not less than 2 and not more than 8.8 times of the numbers of outskirt through-holes 132, 132*b*, and 132*c*. Furthermore, the sums of the areas of the outskirt through-holes 132, 132*b*, and 132*c* of the burner according to the embodiments of the present disclosure may be not less than 10.6% and not more than 33.6% of the sums of the areas of the through-holes 131, 131*b*, 131*c*, 132, 132*b*, and 132*c* disposed in the distribution plates 13, 13*b*, and 13*c*. Furthermore, the sum of the areas of the central through-holes 131, 131*b*, and 131*c* of the burner according to the embodiments of the present disclosure may be not less than 66.3% and not more than 89.4% of the sum of the through-holes 131, 131*b*, 131*c*, 132, 132*b*, and 132*c* disposed in the distribution plates 13, 13*b*, and 13*c*. The number of through-hole rows of the central portion A31 of the third embodiment may be larger than the number of the through-hole rows of the central portion A21 of the second embodiment.

Figure 6:
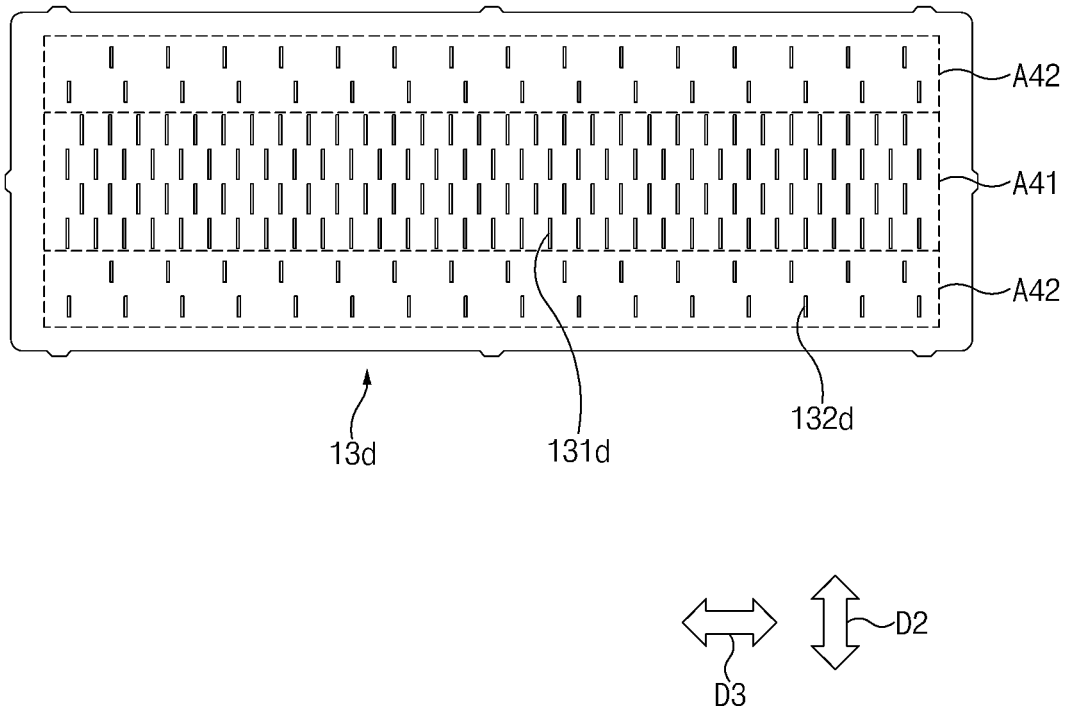
FIG. 6 is a view illustrating a shape of a distribution plate of a burner according to a fourth embodiment of the present disclosure.

FIG. 6 is a view illustrating a shape of a distribution plate of a burner according to a fourth embodiment of the present disclosure.

A shape of a distribution plate 13*d* according to the fourth embodiment of the present disclosure is different from a shape of the distribution plate according to the first to third embodiments in detailed sizes. The contents of the water heater 1 according to the first embodiment may be directly applied to the remaining components of the water heater according to the fourth embodiment, except for a shape of the distribution plate 13*d* of the burner according to the fourth embodiment.

Referring to the drawing, the areas of outskirt through-holes 132*d* that are the through-holes disposed at an outskirt portion A42 may be smaller than the areas of central through-holes 131*d* that are the through-holes disposed at a central portion A41. In detail, the widths of the outskirt through-holes 132*d* along the widthwise direction D2 is smaller than the widths of the central through-holes 131*d* along the widthwise direction D2. The widths of, among the outskirt through-holes 132*d*, the outer through-holes located on an outside along the widthwise direction D2 may be smaller than the widths of the inner through-holes located on an inner side.

Figure 7:
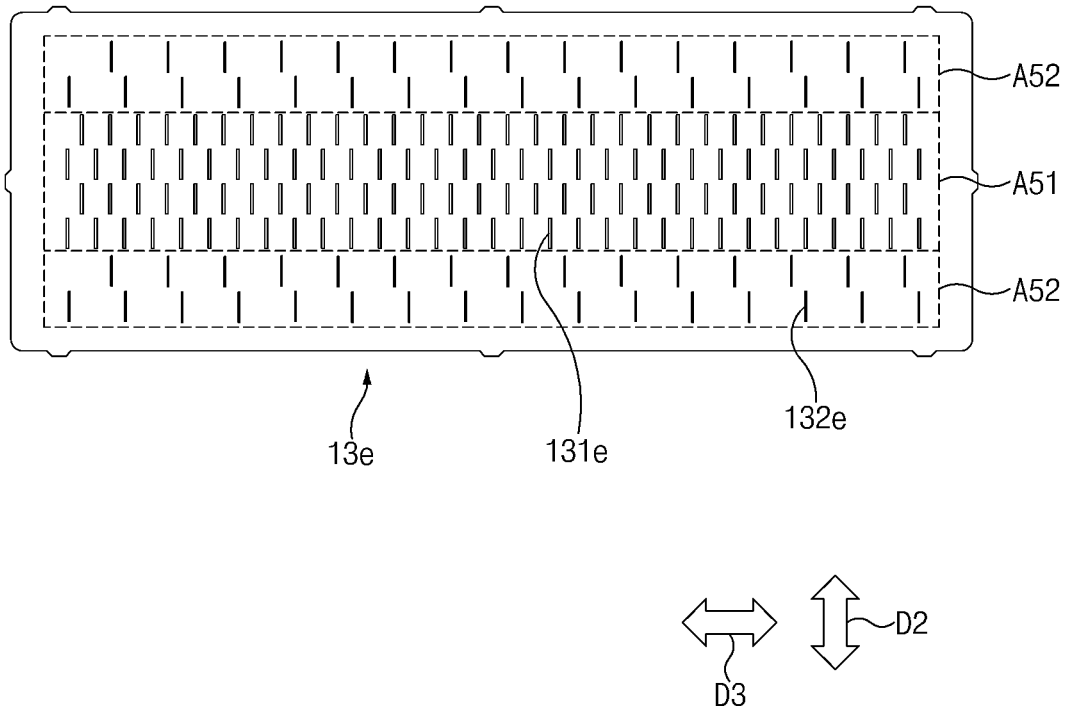
FIG. 7 is a view illustrating a shape of a distribution plate of a burner according to a fifth embodiment of the present disclosure.

FIG. 7 is a view illustrating a shape of a distribution plate of a burner according to a fifth embodiment of the present disclosure.

A shape of a distribution plate 13*e* according to the fifth embodiment of the present disclosure is different from a shape of the distribution plate according to the first to fourth embodiments in detailed sizes. The contents of the water heater 1 according to the first embodiment may be directly applied to the remaining components of the water heater according to the fifth embodiment, except for a shape of the distribution plate 13*e* of the burner according to the fifth embodiment.

Referring to the drawing, the areas of outskirt through-holes 132*e* that are the through-holes disposed at an outskirt portion A52 may be smaller than the areas of central through-holes 131*e* that are the through-holes disposed at a central portion A51. In detail, the thicknesses of the outskirt through-holes 132*e* along the lengthwise direction D3 may be smaller than the thicknesses of the central through-holes 131*e* along the lengthwise direction D3. The widths of, among the outskirt through-holes 132*e*, the outer through-holes located on an outside along the widthwise direction D2 may be smaller than the widths of the inner through-holes located on an inner side.

Figure 8:
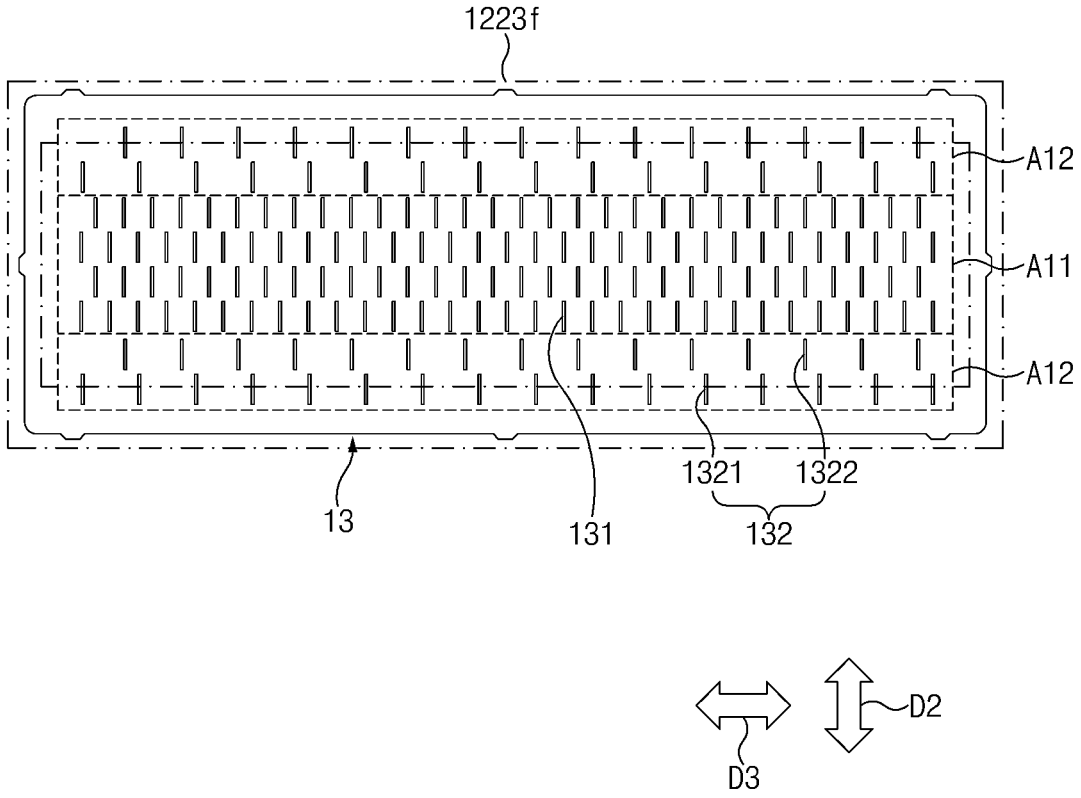
FIG. 8 is a view illustrating a state, in which a bracket stopping part of a burner frame covers a distribution plate, according to a sixth embodiment of the present disclosure.

FIG. 8 is a view illustrating a state, in which a bracket stopping part 1223*f* of a burner frame covers the distribution plate 13, according to a sixth embodiment of the present disclosure.

The water heater according to the sixth embodiment of the present disclosure is different from the water heaters according to the first to fifth embodiments only in that a portion of the bracket stopping part 1223*f* covers some of the outskirt through-holes 132. The contents of the water heater 1 according to the first embodiment may be directly applied to the remaining components of the water heater according to the sixth embodiment, except for a shape of the bracket stopping part 1223*f* according to the sixth embodiment.

An inner end of the bracket stopping part 1223*f* of the burner frame in the widthwise direction may cover portions of the outskirt through-holes 132 that are through-holes disposed at the outskirt portion A12. The inner end of the bracket stopping part 1223*f* in the widthwise direction may cover at least a partial area of the outer through-holes 1321. The inner end of the bracket stopping part 1223*f* in the widthwise direction may cover a partial area of the inner through-holes 1322. Accordingly, the entire area of the outskirt through-holes 132 may be reduced as the bracket stopping part 1223*f* covers the outskirt through-holes 132.

Figure 9:
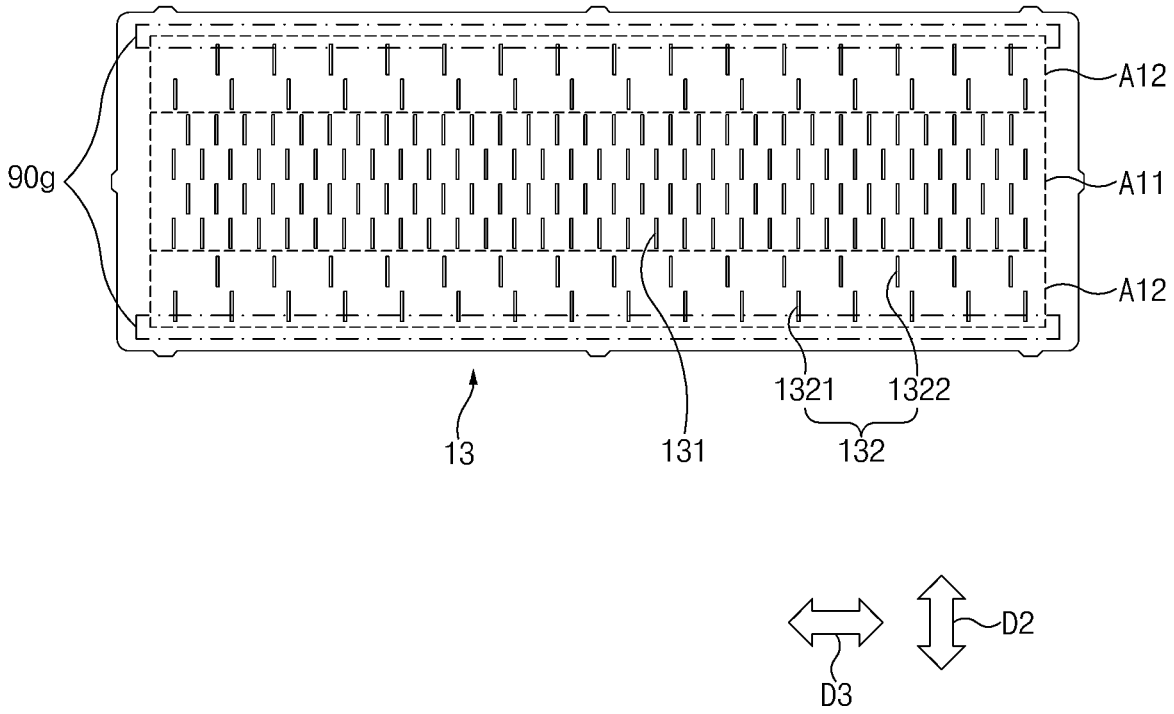
FIG. 9 is a view illustrating a state, in which a cover plate covers a distribution plate, according to a seventh embodiment of the present disclosure.

FIG. 9 is a view illustrating a state, in which a cover plate 90*g* covers the distribution plate 13, according to a seventh embodiment of the present disclosure.

The water heater according to the seventh embodiment of the present disclosure is different from the water heaters according to the first to sixth embodiments only in that it further has the covering plate 90*g*. The contents described for the water heater 1 according to the first embodiment may be applied as it is to the other components of the water heater according to the seventh embodiment.

The water heater may include the covering plate 90*g*. The covering plate 90*g* may be formed of a material including stainless steel. The covering plate 90*g* may cover some of the through-holes, which are adjacent opposite ends of the distribution plate 13 in the widthwise direction. The covering plate 90*g* may be divided into two parts to be spaced apart from each other in the widthwise direction D2. The covering plate 90*g* may be coupled to the distribution plate 13 or may be coupled to the bracket stopping part 1223 to be fixed.

That is, the covering plate 90*g* may cover portions of the outskirt through-holes 132 that are the through-holes disposed at the outskirt portion A12. The covering plate 90*g* may cover at least a partial area of the outer through-holes 1321. The covering plate 90*g* may cover a partial area of the inner through-holes 1322. Accordingly, an entire area of the outskirt through-holes 132 may be reduced as the covering plate 90*g* covers the outskirt through-holes 132.

Figure 10:
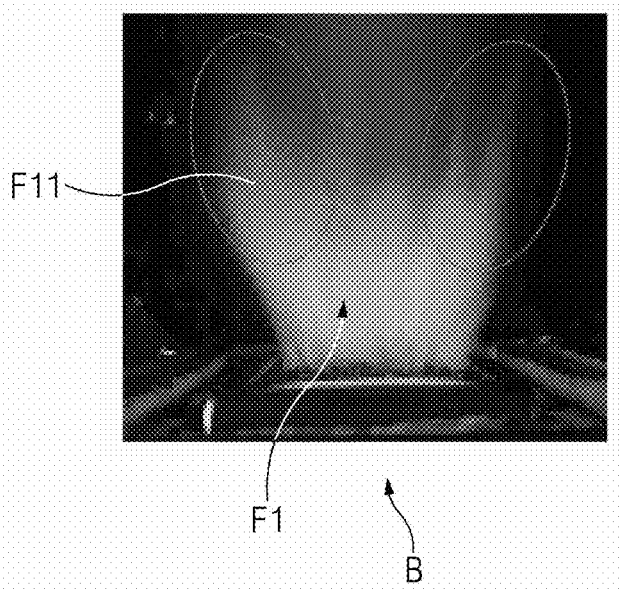
FIG. 10 is a view illustrating a shape of frames generated in a burner using an exemplary distribution plate.
Figure 11:
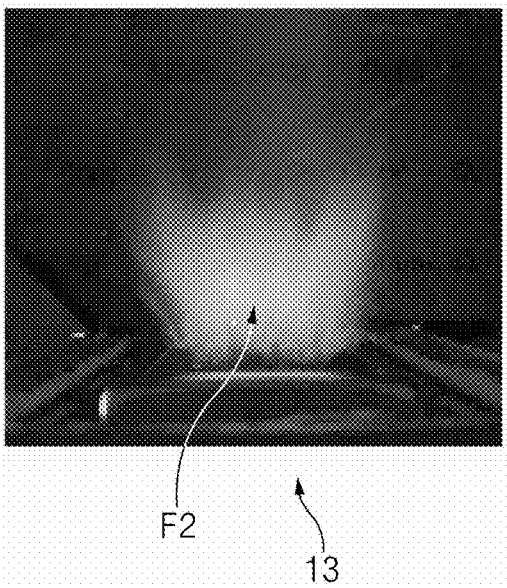
FIG. 11 is a view illustrating a shape of flames generated in a burner according to a first embodiment of the present disclosure.

FIG. 10 is a view illustrating a shape of frames generated in a burner "B" using an exemplary distribution plate. FIG. 11 is a view illustrating a shape of flames generated in the burner 10 according to the first embodiment of the present disclosure.

An exemplary case, in which a distribution plate, in which through-holes are uniformly disposed while the number of the through-holes is not adjusted, is used, may be considered. When flames F1 are formed through a combustion reaction by using a burner "B" including the exemplary distribution plate, flames F11 that are formed on an outside with respect to the widthwise direction are flown to be formed to be large as in FIG. 10, and the above-described incomplete combustion may occur as the flames F11 contact the side wall of the combustion chamber.

FIG. 11 illustrates a shape of flames F2 that may be obtained when the distribution plate 13 according to the first embodiment of the present disclosure is used, and, as compared with FIG. 10, it may be identified that the flames formed on an outside with respect to the widthwise direction D2 are reduced. Accordingly, the flames may not reach a portion of the side wall of the combustion chamber 20, which contacts the combustion chamber heat insulating pipeline 51, incomplete combustion that may occur in the exemplary burner 10 may be reduced, carbon monoxide may be reduced, and an efficiency of the water heater 1 may be increased.

Even when it has been described above that all the components that constitute the embodiments of the present disclosure are combined into one or are combined to be operated, the present disclosure is not limited to the embodiments. That is, all the components may be selectively combined into one to be operated with a range of the purpose of the present disclosure. Further, because the above-described terms, such as "comprising", "including", or "having" mean that the corresponding components may be included unless particularly described in an opposite way, it should be construed that another component is not excluded but may be further included. Unless defined differently, all the terms including technical or scientific terms have the same meanings as those generally understood by an ordinary person in the art, to which the present disclosure pertains.

The generally used terms such as the terms defined in advance should be construed to coincide with the context meanings of the related technologies, and should not be construed as ideal or excessively formal meanings unless defined explicitly in the present disclosure.

The above description is a simple exemplification of the technical spirits of the present disclosure, and the present disclosure may be variously corrected and modified by those skilled in the art to which the present disclosure pertains without departing from the essential features of the present disclosure. Accordingly, the embodiments disclosed in the present disclosure is not provided to limit the technical spirits of the present disclosure but provided to describe the present disclosure, and the scope of the technical spirits of the present disclosure is not limited by the embodiments. Accordingly, the technical scope of the present disclosure should be construed by the attached claims, and all the technical spirits within the equivalent ranges fall within the scope of the present disclosure.

The invention claimed is:

1. A burner for a water heater, which is located on an upstream side of a combustion chamber with respect to a reference direction that is a flow direction of a combustion gas generated through a combustion reaction, the burner comprising:

a plate-shaped distribution plate configured to generate the combustion reaction, wherein when one direction that is perpendicular to the reference direction is defined as a lengthwise direction and a direction that is perpendicular to the reference direction and the lengthwise direction is defined as a widthwise direction, a plurality of through-holes are disposed in the distribution plate along the reference direction to be spaced apart from each other along the lengthwise direction and the widthwise direction such that a mixture of a fuel and air for the combustion reaction pass therethough, and the distribution plate includes a central portion located at a center with respect to the widthwise direction, and outskirt portions located on opposite sides of the central portion, and wherein a penetration density obtained by dividing a sum of areas of the through-holes located at the outskirt portions by areas of the outskirt portions is smaller than a penetration density obtained by dividing a sum of areas of the through-holes located at the central portion by an area of the central portions, wherein a spacing interval between the through-holes disposed in the central portion is smaller than a spacing interval between the through-holes disposed at the outskirt portions.

2. The burner of claim 1, wherein the penetration density of the outskirt portions is not more than 70% of the penetration density of the central portion.

3. The burner of claim 1, wherein widths of the outskirt portions with respect to the widthwise direction are smaller than a width of the central portion.

4. The burner of claim 3, wherein the widths of the outskirt portions are not less than 9.5% and not more than 25% of a width of the distribution plate, and wherein the width of the central portion is not less than 50% and not more than 81% of the area of the distribution plate.

5. The burner of claim 1, wherein the numbers of through-holes disposed at the outskirt portions is smaller than the number of through-holes disposed at the central portion.

6. The burner of claim 5, wherein the number of through-holes disposed at the central portion is not less than 2 times and not more than 8.5 times of the numbers of through-holes disposed at the outskirt portions.

7. The burner of claim 1, wherein a sum of the areas of the through-holes disposed at the outskirt portions is smaller than a sum of the areas of the through-holes disposed at the central portion.

8. The burner of claim 7, wherein the sum of the areas of the through-holes disposed at the outskirt portions is not less than 10.6% and not more than 33.6% of a sum of the areas of the through-holes disposed at the distribution plate, and wherein the sum of the areas of the through-holes disposed at the central portion is not less than 66.3% and not more than 89.4% of the sum of the areas of the through-holes disposed at the distribution plate.

9. The burner of claim 1, wherein the through-holes disposed at the outskirt portions include outer through-holes disposed at an outermost side with respect to the widthwise direction, and inner through-holes disposed on an inner side of the outer through-holes.

10. The burner of claim 9, wherein the outer through-holes and the inner through-holes are alternately disposed along the lengthwise direction to be spaced apart from each other when viewed along the widthwise direction, and wherein the outer through-holes and the inner through-holes are disposed to be spaced apart from each other by a first interval and a second interval alternately.

11. The burner of claim 1, wherein areas of the through-holes disposed at the outskirt portions are smaller than areas of the through-holes disposed at the central portion.

12. The burner of claim 1, wherein widths of the through-holes disposed at the outskirt portions, along the widthwise direction, is smaller than widths of the through-holes disposed at the central portion, along the widthwise direction.

13. The burner of claim 1, wherein thicknesses of the through-holes disposed at the outskirt portions, along the lengthwise direction, is smaller than thickness of the through-holes disposed at the central portion, along the lengthwise direction.

14. The burner of claim 1, further comprising:

a burner frame having an opening at a center thereof, and to which opposite widthwise and lengthwise ends of the distribution plate are coupled such that the distribution plate is disposed to close the opening, wherein widthwise inner ends of the burner frame are disposed at the outskirt portions.

15. The burner of claim 1, further comprising:

a cover plate covering a portion of, among the through-holes disposed at the outskirt portions, the through-holes that are adjacent to the opposite widthwise ends of the distribution plate, and wherein the cover plate is formed of a material including stainless steel.

16. The burner of claim 1, wherein the distribution plate includes a combustion area that is an area, in which the combustion reaction is generated, wherein the combustion area has a profile that is formed to be convex downwards in a cross-section taken along a plane that is perpendicular to the lengthwise direction, and wherein the combustion area is formed such that a normal line drawn from at least one of two outer points located on an outermost side with respect to the widthwise direction does not contact an inner surface of the combustion chamber.

17. A water heater comprising:

a burner including a mixing chamber, in which a fuel and air are mixed to generate a mixture, and a plate-shaped distribution plate configured to generate a combustion reaction when the mixture is ejected;

a combustion chamber configured such that flames generated through the combustion reaction are located in an interior thereof;

a heat exchanger configured to heat water by using heat generated through the combustion reaction; and a combustion chamber heat insulating pipeline configured such that water flows to an outside of the combustion chamber for heat-insulating the combustion chamber, wherein when a direction, in which the combustion gas generated through the combustion reaction flows, is defined as a reference direction, one direction that is perpendicular to the reference direction is defined as a lengthwise direction, and a direction that is perpendicular to the reference direction and the lengthwise direction is defined as a widthwise direction, a plurality of through-holes are disposed in the distribution plate along the reference direction to be spaced apart from each other along the lengthwise direction and the widthwise direction such that the mixture pass therethrough, and the distribution plate includes a central portion located at a center with respect to the widthwise direction, and outskirt portions located on opposite sides of the central portion, and wherein the through-holes formed at the outskirt portions are disposed such that outer distal ends of flames formed by the mixture passing through the through-holes disposed at the outskirt portions with respect to the widthwise direction are located on an inner side of a portion of a side wall of the combustion chamber, which contacts the combustion chamber heat insulating pipeline, wherein a spacing interval between the through-holes disposed in the central portion is smaller than a spacing interval between the through-holes disposed at the outskirt portions.

* * * * *